United States Patent [19]

Bichet

[11] 4,454,619

[45] Jun. 19, 1984

[54] GLUE PRESS FOR MAKING ANKLE BOOTS

[75] Inventor: Lucien Bichet, Draveil, France

[73] Assignee: Anver, Maisons Alfort, France

[21] Appl. No.: 367,352

[22] Filed: Apr. 12, 1982

[30] Foreign Application Priority Data

May 6, 1981 [FR] France ..... 81 08962

[51] Int. Cl.[3] ..... A43D 11/00

[52] U.S. Cl. ..... 12/54.2; 12/53.5

[58] Field of Search ..... 12/54.2, 54.4, 54.3, 12/53.5

[56] References Cited

U.S. PATENT DOCUMENTS 2,484,876 10/1949 Dodge ..... 12/54.2

2,745,124 5/1956 Germain ..... 12/54.2

*Primary Examiner*—Patrick D. Lawson

*Attorney, Agent, or Firm*—Browdy and Neimark

[57] ABSTRACT

A press comprising a flexible pocket or elastic membrane, that is adjustable in height and serves as a means for exerting a uniform enveloping pneumatic or hydraulic pressure, between the glued insole and the mounted upper of an article of footwear, which is held between locking elements during the exertion of pressure by the pocket. The locking elements consist of a single shaper closely contacting the contours of the footwear and remaining fixed on the press frame, during operation of said pocket, and a toe support that is placed against the base of the upper at the level of the instep. Thus, any creasing of the upper portion of the footwear is avoided by securely holding the footwear immobile during the pressure operation.

4 Claims, 3 Drawing Figures

GLUE PRESS FOR MAKING ANKLE BOOTS

FIELD OF THE INVENTION

This invention relates to glue presses for making footwear and other leather articles. The press includes a pocket or elastic membrane which serves as a means for exerting pressure between the glued insole and the mounted upper or body of the foorwear. It relates more particularly to an improved press, especially adapted for the gluing of ankle boots, such as sport shoes, ankle boots, high boots or the like.

BACKGROUND OF THE INVENTION

For a long time shoe presses have been known which comprise, in a rigid and undeformable enclosure, a flexible and impermeable membrane which, while exerting a hydraulic or pneumatic pressure around the shoe, is applied exactly on the contours of the elements to be glued, which are introduced in this enclosure or pocket (i.e., Pic press, French Pat. No. 1,1035,989 of Apr. 20, 1951).

To adapt this known apparatus for use in the particular case of gluing elements of footwear, the mounted upper of which is high or very high, as for example, ankle boots, high boots or similar articles, applicant herein has developed improved machines for this purpose. More particularly, he has developed a glue press for making ankle boots, in which press the flexible pocket is made adjustable in height depending on the type of footwear to be manufactured and is designed to exert a uniform enveloping pressure at all points of the footwear, which are held in a fixed position (see French patent application No. 79.27634 of 11/9/1979).

In this type of press, the front and back part of the footwear are each held in a shaper while pressure is exerted in the flexible pocket of the device. These shapers are hard to adjust for proper operation as a function of the shape of the footwear. Further, because the middle part of the footwear is not locked in, the pressure exerted on the upper part of the footwear tends to crush the latter somewhat and thus creases may be produced on the upper which may make it necessary to reject the footwear as being unsatisfactory.

OBJECTS AND SUMMARY OF THE INVENTION

The invention aims at remedying these drawbacks and, while maintaining a press structure having a flexible pocket that is adjustable in height as in the patent application cited, proposes a means for making it possible both to avoid any deformation of the insole when pressure is exerted thereon and for obtaining a perfect fluid tightness between the footwear and the pocket or elastic membrane of the device.

To achieve this end and others that will become apparent from the following specification, applicant has developed an apparatus, which includes as locking elements for the footwear, a shaper of a new type that tightly contacts the insole and sides of the footwear over almost its entire length. This shaper simply leaves free the front end of the footwear for passage of a toe support which, before putting of the pocket under pressure, is placed against the base of the upper.

BRIEF DESCRIPTION OF THE DRAWINGS

The invention will be better understood from the detailed description of a nonlimiting embodiment illustrated by the accompanying drawings which diagrammatically represent.

DETAILED DESCRIPTION OF PREFERRED EMBODIMENTS

Figure 1:
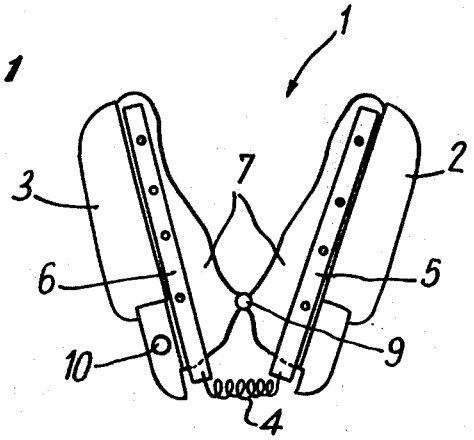
FIG. 1: a general view of a type of shaper according to the invention.

As shown, particularly in FIG. 1, shaper 1 is molded, as a single piece from a silicone resin or the like, and is provided with two sides 2 and 3 adapted to close one on the other due to the action of a spring 4, which is connected to two metal plates 5 and 6, each of which is fastened onto one of, said sides respectively. At its base, the shaper has a shaped skirt 7 which encompasses the configuration of the footwear and opposes the exiting of the pocket from the press compartment when the pocket is put under pressure.

Figure 2:
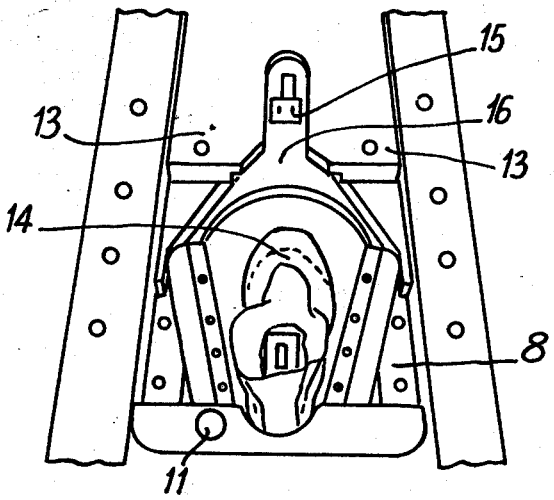
FIG. 2: a compartment of the press having a toe support, in which is placed a piece of footwear in the open position of the shaper.

According to another characteristic of the invention, shaper 1 does not undergo lengthwise and/or crosswise movement during the working of the press. For this purpose, it is kept immovable with respect to a stationary frame 8 of the press, for example, by means of an articulation pin, which extends from an opening 9 provided in the center of the back part of the shaper, and by means of a stud, the passage hole 10 of which is seen in FIG. 1, and by means of a screwable fastening button 11, which is seen in FIG. 2.

Figure 3:
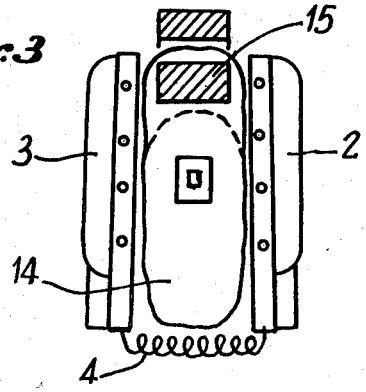
FIG. 3: illustration of the position of the shaper and the toe support which are coordinated with one another just before inflation of the pocket for gluing the footwear elements under pressure.

The press, having a generally known structure and function, is not shown in the figures. It generally works on a pair of footwear, by introducing a last or punch on the inside of the footwear. The press work table comprises sliding plates or drawers 13 that close on the footwear when the latter is enclosed in shaper 1, as shown diagrammatically in FIG. 3.

When the shaper contacts footwear 4, the toe support 15, which is guided in groove 16 of the press plate, is placed on the base of the upper, i.e., at the site of the instep. Thus, during the gluing or fusing phase of the operation when the pocket is put under pressure and held by skirt 7 of the shaper, the footwear is held firmly in all directions and no crushing of the upper part of the footwear occurs as occurred in the known prior art presses, described above.

Because of the improved device of the invention, not only are crease defects in the footwear eliminated but placement of the footwear, in the open position of the shaper, is facilitated. Further, the same shaper is suitable for making footwear of six or seven sizes of a given type. Finally, although the improved locking elements of the invention are especially suited for the making of ankle boots, they offer the same advantages, as those indicated above, when used in making low quarter shoes and training style shoes having a raised front and back part.

While the invention has been described in detail above, it is to be understood that this detailed description is by way of example only, and the protection granted is to be limited only within the spirit of the invention and the scope of the following claims.

I claim:

1. Gluing press for exerting pressure on ankle boots, high boots or similar articles, said press comprising a flexible pocket or elastic membrane that is adjustable in height and serves as a means for exerting a uniform enveloping pneumatic or hydraulic pressure, between the glued insole and the mounted upper of the footwear, said footwear being held between locking elements when pressure is exerted by the pocket, said locking elements comprising a combination of a single shaper enveloping the upper and a toe support which contacts the base of said upper, and said press acting to glue the entire footwear insole to the upper in a single operation and to do so with substantially no deformation of said footwear being glued.

2. Press according to claim 1, wherein the shaper comprises two sides and opens and closes like a clamp around said upper but remains stationary, in the lengthwise direction, during operation of the pressure exerting flexible pocket.

3. Press according to claim 2, wherein the position of the shaper is maintained stationary by making the latter immobile with respect to the frame of the press by means of an articulation pin and a stud locking with a button.

4. Press according to either claim 2 or 3, wherein, while the flexible pocket is exerting pressure and the shaper and toe support are firmly locking the footwear against movement, a slide closes on the footwear at the level of the press working table.

* * * * *